US009337557B2

(12) United States Patent
Sakamoto

(10) Patent No.: US 9,337,557 B2
(45) **Date of Patent: *May 10, 2016**

(54) CONNECTOR AND CONNECTION TERMINAL

(71) Applicant: YAZAKI CORPORATION, Minato-ku, Tokyo (JP)

(72) Inventor: Nobuyuki Sakamoto, Makinohara (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 14/574,878

(22) Filed: Dec. 18, 2014

(65) Prior Publication Data

US 2015/0104981 A1 Apr. 16, 2015

Related U.S. Application Data

(63) Continuation of application No. PCT/JP2013/066495, filed on Jun. 14, 2013.

(30) Foreign Application Priority Data

Jul. 3, 2012 (JP) ..... 2012-149393
Jul. 3, 2012 (JP) ..... 2012-149398

(51) Int. Cl.
*H01R 9/22* (2006.01)
*H01R 4/58* (2006.01)
(Continued)

(52) U.S. Cl.
CPC ..... *H01R 4/58* (2013.01); *H01R 13/115* (2013.01); *H01R 13/4223* (2013.01)

(58) Field of Classification Search
CPC ..... H01R 13/26; H01R 4/489; H01R 4/4872; H01R 4/50; H01R 4/5008; H01R 4/16; H01R 13/36; H01R 31/00; H01R 31/02; H01R 2101/00
USPC ..... 439/708, 701, 682
See application file for complete search history.

(56) References Cited

U.S. PATENT DOCUMENTS 2,396,725 A * 3/1946 Thomas, Jr. ..... H01R 4/20 174/84 C
3,075,167 A * 1/1963 Kinkaid ..... H01R 13/432 439/636

(Continued)

FOREIGN PATENT DOCUMENTS

CN 101242056 A 8/2008
CN 201623392 U 11/2010

(Continued)

OTHER PUBLICATIONS

Japanese office action issued on Dec. 8, 2015 in the counterpart Japanese patent application.

(Continued)

*Primary Examiner* — Abdullah Riyami
*Assistant Examiner* — Vladimir Imas
(74) *Attorney, Agent, or Firm* — Mots Law, PLLC

(57) ABSTRACT

A connector includes: a housing in which a communication groove that communicates between adjacent terminal accommodating chambers is formed in a partition wall; and a connection terminal having a terminal body section connected to a wire connection part. The terminal body section includes: a first side wall on which a male connection part is formed; a second side wall provided with a slit; and an elastic part and contact parts which are provided inside the terminal body section and which contact the male connection part inserted in the slit. The communication groove is provided at a position offset from the center in the vertical direction of the terminal accommodating chamber. The male connection part and the slit are provided at a position offset from the center in the vertical direction of the terminal body section so as to correspond to the communication groove.

3 Claims, 9 Drawing Sheets

(51) Int. Cl.
*H01R 13/422* (2006.01)
*H01R 13/115* (2006.01)

(56) References Cited

U.S. PATENT DOCUMENTS 3,193,795 A * 7/1965 Krehbiel ..... H01R 13/26 439/708
3,555,493 A * 1/1971 Baumanis ..... H01R 12/721 439/636
3,720,907 A * 3/1973 Asick ..... H01R 13/428 439/636
3,942,860 A * 3/1976 McDonough ..... H01R 31/02 439/708
3,951,498 A * 4/1976 Michaels ..... H01R 13/26 439/708
4,084,872 A * 4/1978 Pritulsky ..... H01R 25/003 439/513
4,753,613 A * 6/1988 Morgan ..... H01R 13/514 439/291
5,004,434 A * 4/1991 Aiello ..... H01R 12/721 439/636
5,021,003 A * 6/1991 Ohtaka ..... H01R 13/6272 439/357
5,051,100 A * 9/1991 Kato ..... H01R 13/4538 439/137
5,551,883 A * 9/1996 Davis ..... H01R 24/62 439/636
5,564,952 A * 10/1996 Davis ..... H01R 13/113 439/682
5,749,753 A * 5/1998 Chishima ..... H01R 13/113 439/752.5
6,050,858 A * 4/2000 Liu ..... H01R 24/62 439/660
7,252,564 B1 * 8/2007 Morello ..... H01R 4/185 439/843
7,452,242 B2 * 11/2008 Poh ..... H01R 13/533 439/485
7,677,935 B2 * 3/2010 Ogata ..... H01R 13/04 439/845
7,731,520 B1 * 6/2010 Daily ..... H01R 23/27 439/357
8,337,259 B2 * 12/2012 Chen ..... H01R 13/432 439/751
8,714,997 B2 * 5/2014 Ikeda ..... H01R 4/242 439/487
9,054,430 B2 * 6/2015 Sakamoto ..... H01R 4/16

FOREIGN PATENT DOCUMENTS

JP S61-068487 U 5/1986
JP H02-009512 Y2 3/1990
JP H08-293367 A 11/1996
JP H11-345645 A 12/1999
JP 2002-075515 A 3/2002
JP 2002-124333 A 4/2002
JP 2005-166523 A 6/2005
JP 2007-087810 A 4/2007

OTHER PUBLICATIONS

Japanese office action issued on Dec. 1, 2015 in the counterpart Japanese patent application.
The Chinese Office Action issued on Feb. 2, 2016 in the counterpart Chinese patent application.
The Japanese Office Action issued on Jan. 26, 2016 in the counterpart Japanese patent application (No. 2012-149398).
The Japanese Office Action issued on Feb. 16, 2016 in the counterpart Japanese patent application (No. 2012-149393).

* cited by examiner

CONNECTOR AND CONNECTION TERMINAL

CROSS REFERENCE TO RELATED APPLICATIONS

This application is a continuation of International Application No. PCT/JP2013/066495, filed Jun. 14, 2013, and based upon and claims the benefit of priority from Japanese Patent Applications No. 2012-149393 and No. 2012-149398, both filed Jul. 3, 2012, the entire contents of all of which are incorporated herein by reference.

TECHNICAL FIELD

This application relates to a connector which electrically connects a plurality of connection terminals inserted in a housing and a connection terminal which can be inserted in the housing and which is formed by bending a conductive plate having a predetermined shape.

BACKGROUND

Generally, this type of a connector includes a housing and a plurality of connection terminals accommodated in the housing to electrically connect the plurality of connection terminals inserted in the housing.

In the housing, a plurality of terminal accommodating chambers that are respectively separated by a partition wall are provided. A communication groove that communicates adjacent terminal accommodating chambers with each other is formed on each partition wall.

The connection terminal includes a wire connection part to which wire is connected and a box-shaped terminal body section which is integrally formed with the wire connection part (refer to JP 2007-087810 A). On one side wall of the terminal body section, a male connection part (a tongue-like engagement piece) that is partly bent in an approximate L-shape and is opened toward a tip end of the terminal body section is provided. On the other side wall of the terminal body section, a female connection part (a tubular fitting part) to which the male connection part is inserted is formed.

And it is constructed such that the male connection part that is inserted in the female connection part contacts the female connection part formed in the terminal body section of an adjacent connection terminal. This causes the male connection part to contact the adjacent female connection part via the communication groove and the female connection part, and the connection terminals that are adjacent with each other are electrically connected.

SUMMARY

Incidentally, in general, from an advantage that manufacturing of the housing and the connection terminal becomes easy, the communication groove is provided at a middle position in the vertical direction of the terminal accommodating chamber, and the male connection part and the female connection part are provided at a middle position in the vertical direction of the terminal body section.

However, in a conventional connector, since the communication groove, the male connection part, and the female connection part are provided at the middle position in the vertical direction of the terminal accommodating chamber or the terminal body section, even if an insertion orientation of the connection terminal into the housing (for example, an orientation of up and down) is wrong, the male connection part can be inserted in a communication groove of the opposite side from usual. That is, there was a possibility that an insertion orientation of the plurality of connection terminals may be wrong and adjacent connection terminals may not be connected. Therefore, a technology was sought which does not cause an error in the insertion orientation of the plurality of connection terminals and which connects adjacent connection terminals reliably.

Therefore, an object of the present invention is to provide a connector and a connection terminal which make it possible to connect adjacent connection terminals reliably without causing an error in the insertion orientation of the plurality of connection terminals.

To achieve the above object, a connector according to a first aspect of the present invention includes: a housing provided with a plurality of terminal accommodating chambers respectively separated by a partition wall, in which the partition wall has a communication groove formed to communicate the terminal accommodating chambers that are adjacent with each other, and a connection terminal having a wire connection part to which wire is connected and a terminal body section connected to the wire connection part. When the connection terminal is mounted in the housing, the adjacent terminal body sections contact with each other and the adjacent connection terminals are electrically connected. The terminal body section includes: a first side wall on which a male connection part is formed, the male connection part being disposed along an extended direction from a front end to a rear end of the terminal body section and being protruded outward; a second side wall opposite to the first side wall, the second side wall being provided with a slit in which the male connection part can be inserted; and a female contact part provided inside the terminal body section, the female contact part to be contact to the male connection part inserted in the slit. The communication groove is provided at a position offset from the center in the vertical direction of the terminal accommodating chamber. The male connection part and the slit are provided at a position offset from the center in the vertical direction of the terminal body section so as to correspond to the communication groove.

With such a structure, when an insertion orientation (for example. an orientation of up and down) of the connection terminal into the housing is wrong, the male connection part abuts the partition wall and is prevented from being inserted in the communication groove in the opposite side from usual. Accordingly, it is possible to connect adjacent connection terminals with each other reliably without causing an error in the insertion orientation of the plurality of connection terminals.

Moreover, since an error in the insertion orientation of the male connection part can be detected, it is not necessary to separately provide a detection mechanism in the connector, making it possible to keep the connector from becoming complex and large-sized.

It is preferable that the slit is formed so as to pass through the terminal body section along the extended direction of the terminal body section.

With such a structure, when the male connection part of one connection terminal is inserted in a slit of the adjacent other connection terminal, it is possible to insert and attach from both sides of the front end and the rear end of the terminal body section. Thus, it is possible to connect the adjacent connection terminals reliably with each other without causing constraints in an installment order of the adjacent connection terminals.

It is preferable that the terminal body section includes: a front wall disposed in a direction that intersects with the extended direction of the terminal body section, the front wall being located at a front end of the terminal body section; and a rear wall opposite to the front wall, the rear wall being disposed at a rear end of the terminal body section. It is preferable that a cutout through which the male connection part can pass is formed in the front wall and the rear wall respectively at a position that aligns with the slit.

By providing the front wall and the rear wall in the terminal body section, opening at the front end and the rear end of the terminal body section is blocked and strength of the terminal body section is increased. This makes it harder for the terminal body section to become deformed even if an external force is applied to the terminal body section.

Furthermore, by forming the cutouts through which the male connection part can pass, when the male connection part of one connection terminal is inserted in the slit of the adjacent other connection terminal, the male connection part can be prevented from abutting the front wall or the rear wall, thus making the connecting operation of the connection terminals easy.

Also, a connection terminal according to the second aspect of the present invention includes a box-shaped terminal body section formed by bending a conductive plate having a predetermined shape, in which the terminal body sections that are adjacent with each other contact to be electrically connected. The terminal body section includes: a first side wall on which a male connection part is formed, the male connection part being disposed along an extended direction from a front end to a rear end of the terminal body section and being protruded outward; a second side wall opposite to the first side wall, the second side wall being provided with a slit in which the male connection part can be inserted; a female contact part provided inside the terminal body section, the female contact part to be contact to the male connection part inserted in the slit; a front wall disposed in a direction that intersects with the extended direction of the terminal body section, the front wall being located at a front end of the terminal body section; and a rear wall opposite to the front wall, the rear wall being disposed at a rear end of the terminal body section. The slit is formed so as to pass through the terminal body section along the extended direction of the terminal body section. A cutout through which the male connection part can pass is formed in the front wall and the rear wall respectively at a position that aligns with the slit.

It is preferable that the cutout is formed so as to become narrower gradually in a direction from the second side wall toward the first side wall.

According to the aspects of the present invention, it is possible to provide a connector and a connection terminal that can connect adjacent connection terminals with each other reliably without causing an error in an insertion orientation of a plurality of connection terminals.

DETAILED DESCRIPTION

Figure 1:
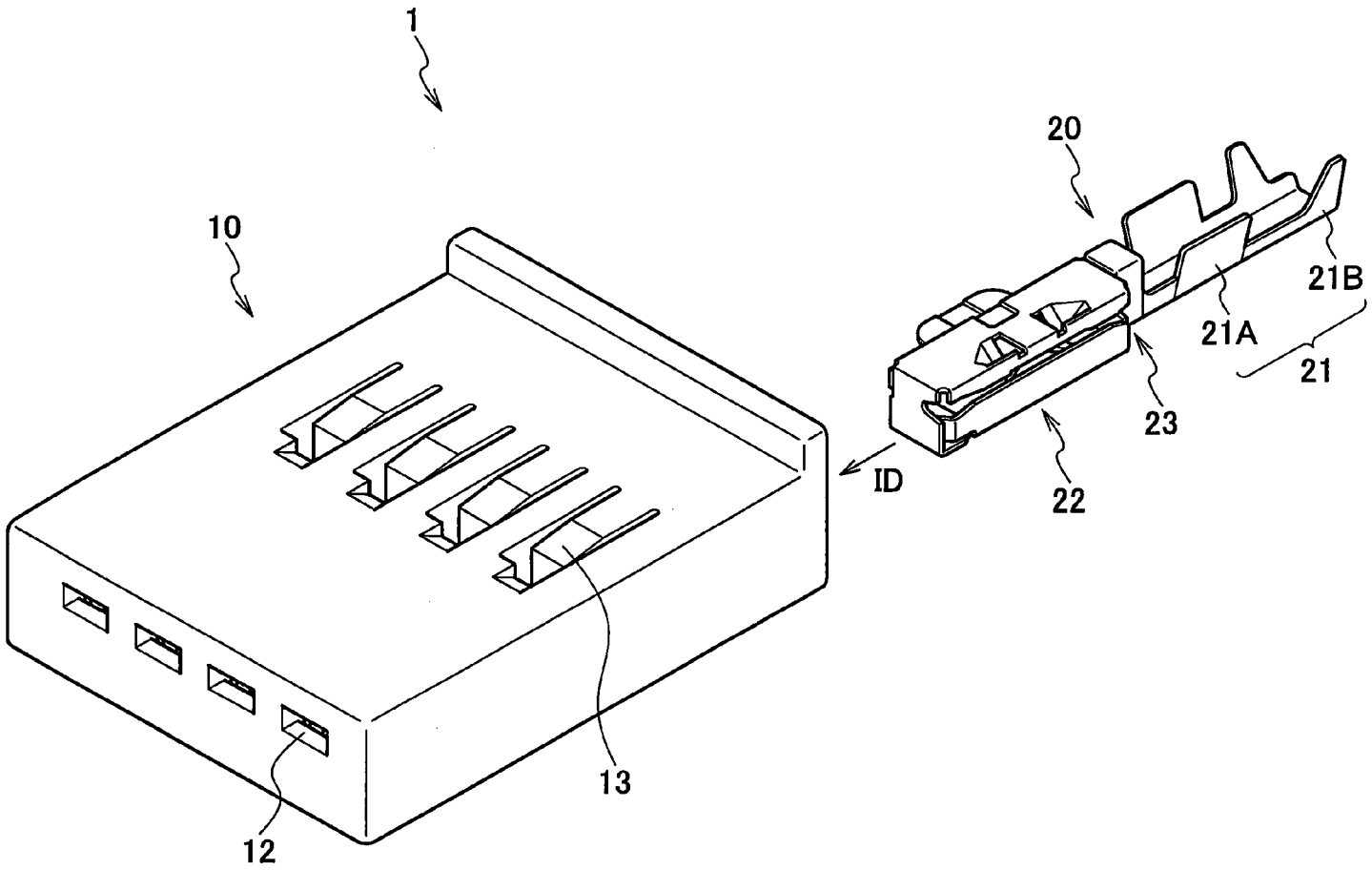
FIG. 1 is an exploded perspective view illustrating a connector according to an embodiment.

Regarding a connector according to an embodiment of the present invention, explanations will be given by referring to the drawings. In the description of the drawings below, the same or similar symbols will be affixed to the same or similar parts. However, it should be noted that the drawings are schematic and the ratio of each dimension and the like may be different from reality. Therefore, specific dimensions and the like should be determined by making allowance for the explanations below. Also, among the drawings, there may be a part where a dimensional relationship or ratio may be different from each other.

A construction of a connector 1 according to the embodiment will be explained by referring to FIGS. 1 to 6.

Figure 2:
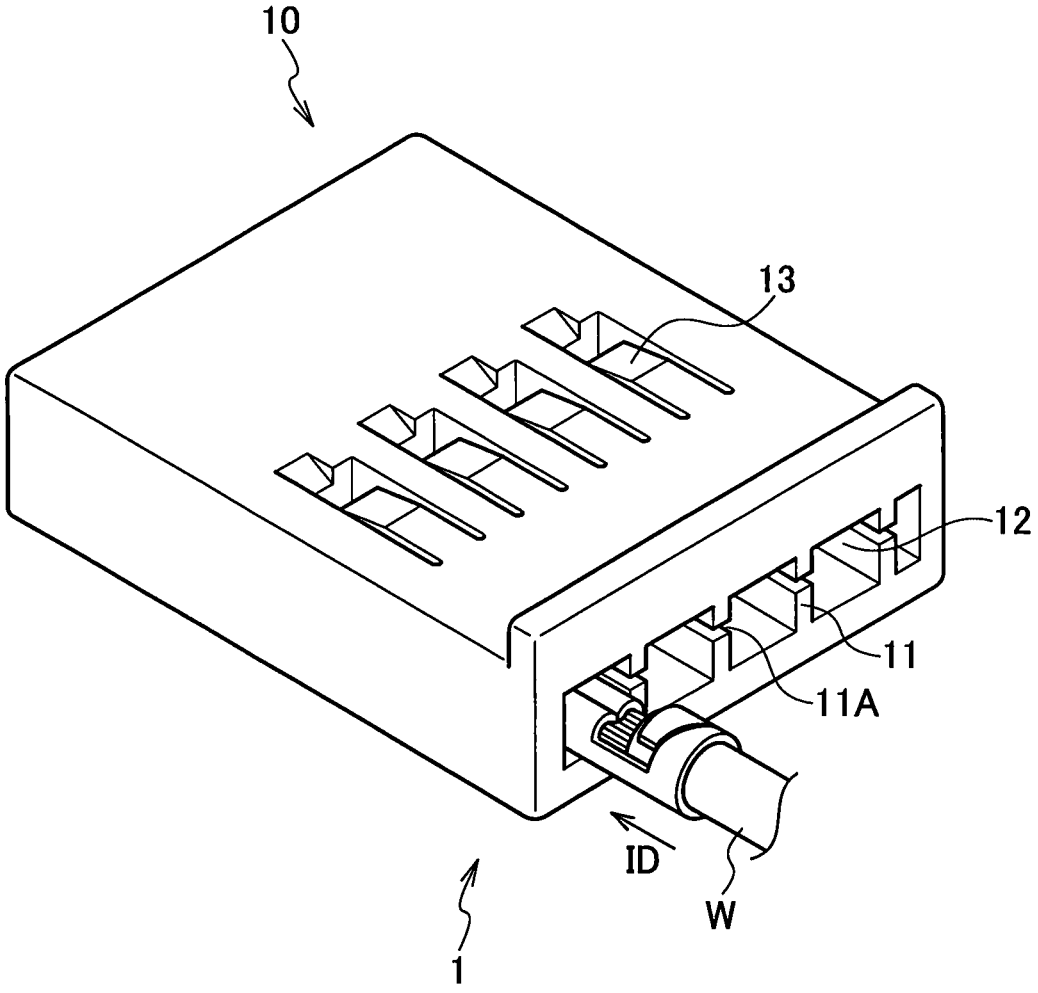
FIG. 2 is an assembled perspective view illustrating the connector according to the embodiment.
Figure 3A:
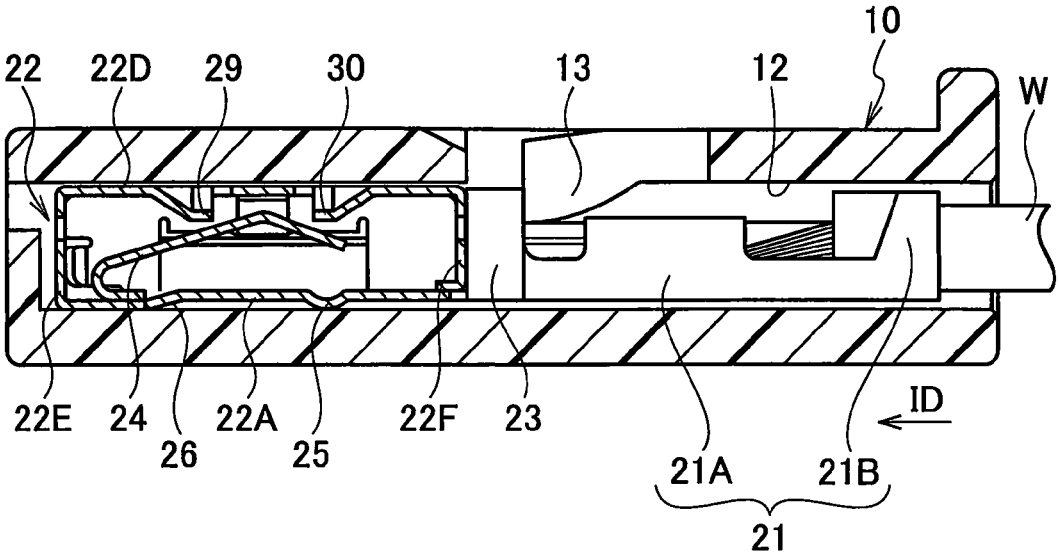
FIG. 3A is a cross-sectional view illustrating the connector according to the embodiment.
Figure 3B:
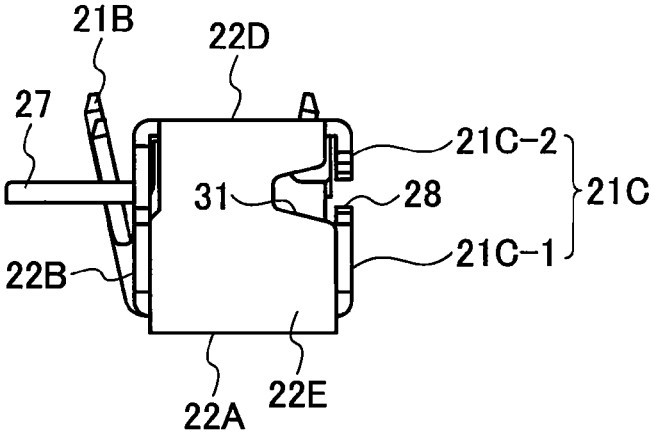
FIG. 3B is a front view illustrating the connector according to the embodiment.
Figure 4A:
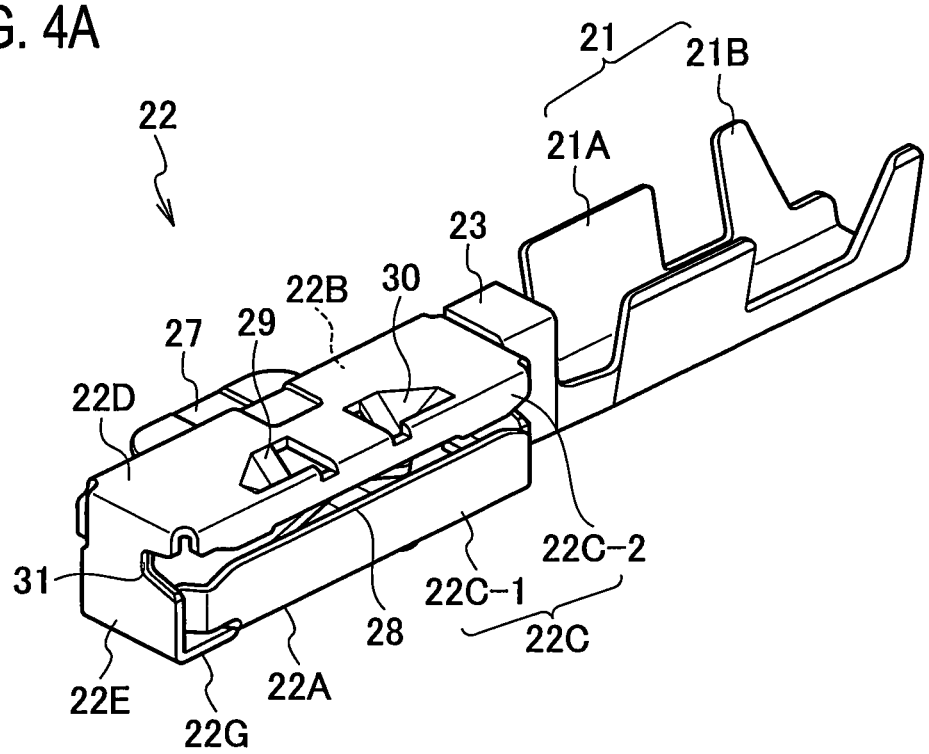
FIGS. 4A and 4B are perspective views of a connection terminal according to the embodiment seen from the upper wall side.
Figure 4B:
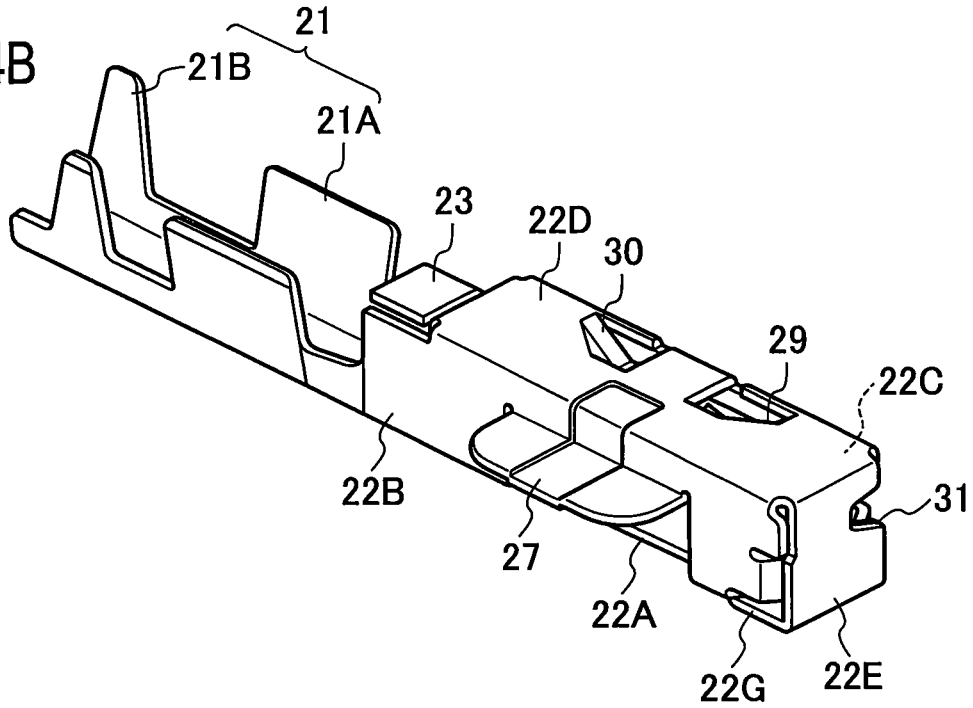
Figure 5A:
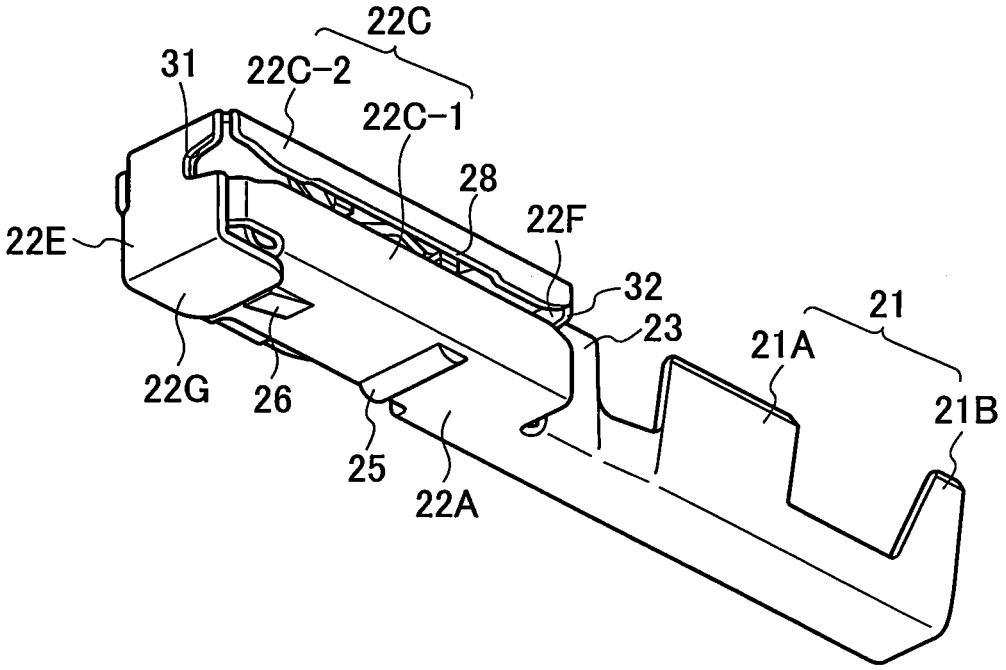
FIGS. 5A and 5B are perspective views of the connection terminal according to the embodiment seen from the bottom wall side.
Figure 5B:
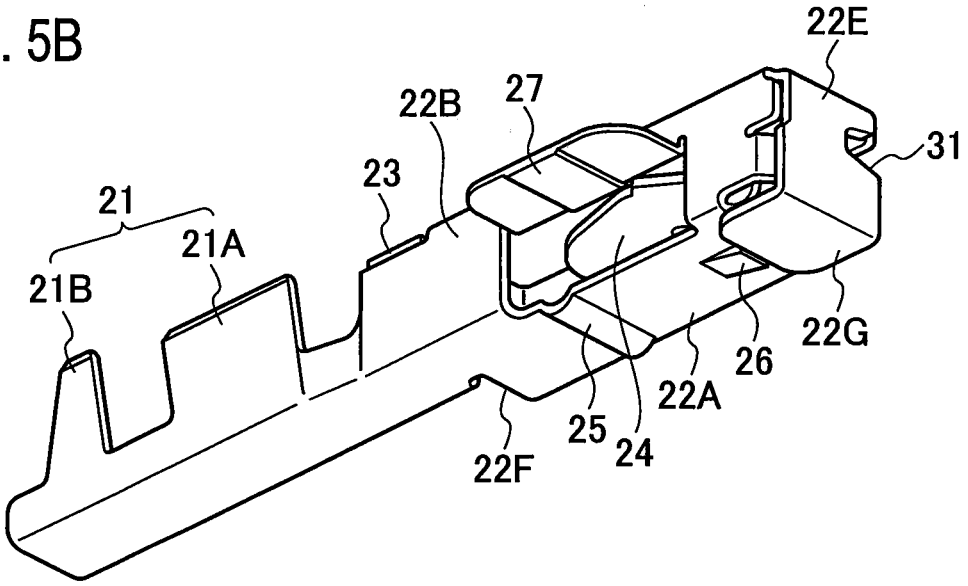

As illustrated in FIGS. 1 to 3, the connector 1 includes a housing 10 and a plurality of connection terminals 20 accommodated in the housing 10, and it electrically connects between the plurality of connection terminals 20 accommodated in the housing 10. Further, in FIGS. 1 and 2, only one connection terminal 20 is illustrated and other connection terminals 20 are omitted of their illustrations.

In the housing 10, a plurality of terminal accommodating chambers 12 respectively separated by a partition wall 11 are provided. At each partition wall 11, a communication groove 11A that communicates between the adjacent terminal accommodating chambers 12 is formed. The communication groove 11A is provided at a position offset from the center in the vertical direction of the terminal accommodating chamber 12 (towards the top side in the embodiment).

Lances 13 are integrally formed with the housing 10. Each lance 13 is formed in a cantilever fashion and is displaceably protruded inward of the respective terminal accommodating chamber 12.

Figure 6:
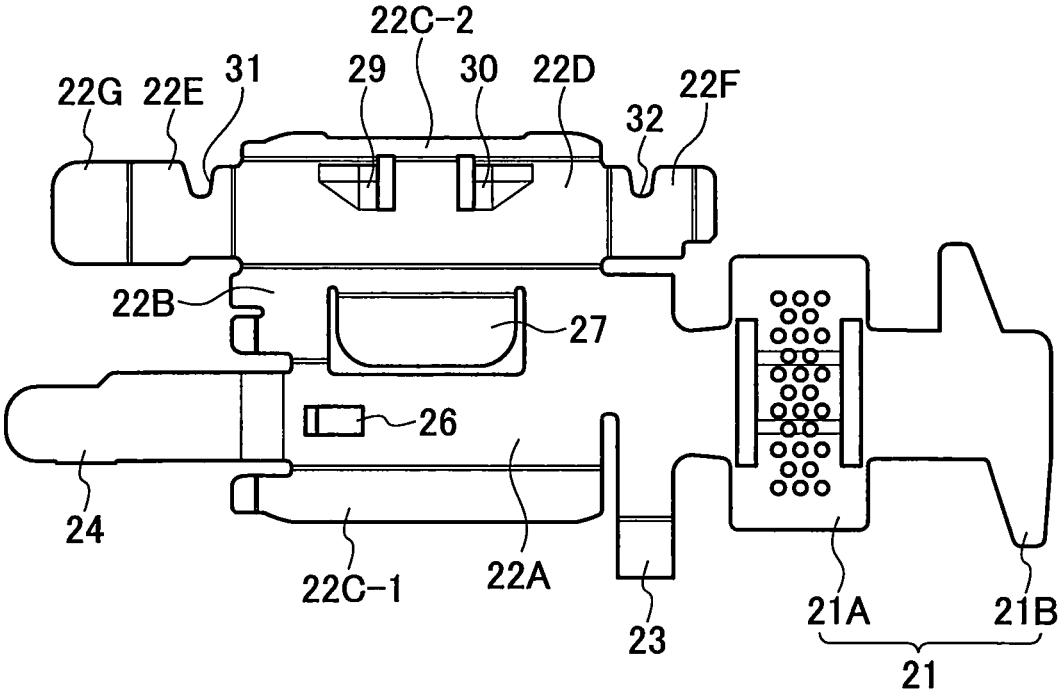
FIG. 6 is a development view illustrating the connection terminal according to the embodiment.

The connection terminal 20 is formed by bending work of a conductive plate 2 having a predetermined shape such as illustrated in FIG. 6. The connection terminal 20 includes a wire connection part 21 to which wire W is connected, a box-shaped terminal body section 22 provided integrally with the wire connection part 21, and a lance engagement section 23 provided on the wire connection part 21 side of the terminal body section 22 and to which the lance 13 is engaged.

The wire connection part 21 includes a core wire crimping part 21A to be crimped to a core wire of the wire W, and an insulating layer crimping part 21B to be crimped to an insulating layer covering the core wire of the wire W. The wire connection part 21 is provided at a position out of alignment with the terminal body section 22 (toward a first side wall 22B). With such a structure, when the connection terminal 20 is inserted in the housing 10, it is made such that the wire connection part 21 does not contact the male connection part 27 of the adjacent connection terminal 20.

The terminal body section 22 is provided along an extended direction from the front end to the rear end of the terminal body section 22 (hereinafter, an insertion direction ID of the connection terminal 20 into the housing 10). The terminal body section 22 includes a bottom wall 22A, a first side wall 22B, a second side wall 22C, and an upper wall 22D, each along the insertion direction ID of the connection terminal 20, and a front wall 22E and a rear wall 22F each along a direction that intersects with the insertion direction ID of the connection terminal 20.

An elastic part 24 of a cantilever type folded from the tip end of the insertion direction ID of the connection terminal 20 is integrally formed at the bottom wall 22A. The elastic part 24 is disposed inside the terminal body section 22 and constitutes a female contact part which contacts the male connection part 27 of the adjacent connection terminal 20.

At the bottom wall 22A, a protruding part 25 that protrudes outward and a sloped piece 26 disposed on the more front side than the protruding part 25 with respect to the insertion direction ID of the connection terminal 20 into the housing 20 are formed. The protruding part 25 protrudes up to a position that corresponds to a thickness of a front end folded part 22G which is turned back from the front wall 22E, securing a balance of the connection terminal 20 inside the housing 10. The sloped piece 26 gradually slopes toward the front end folded part 22G, preventing the front end folded part 22G from becoming caught on the terminal accommodating chamber 12 when the connection terminal 20 is pulled out of the housing 10.

At the first side wall 22B, a male connection part 27 is provided by being folded outward (in the horizontal direction) from the first side wall 22B such that it protrudes. The male connection part 27 is provided at a position offset from the center in the vertical direction of the first side wall 22B (in the embodiment, toward the upper wall 22D side of the first side wall 22B) such that it corresponds to the communication groove 11A. When the connection terminal 20 is mounted in the housing 10, the male connection part 27 is inserted in the communication groove 11A.

The second side wall 22C is opposite to the first side wall 22B. The second side wall 22C is formed by a lower second side wall 22C-1 folded from the bottom wall 22A and an upper second side wall 22C-2 folded from the upper wall 22D. The lower second side wall 22C-1 and the upper second side wall 22C-2 are disposed to be separated in the vertical direction.

That is, a slit 28 is formed at the second side wall 22C to which the male connection part 27 of the adjacent connection terminal 20 can be inserted. The slit 28 is formed at the second side wall 22C such that it passes through the terminal body section 22 along the insertion direction ID. Similarly to the male connection part 27, the slit 28 is provided at a position offset from the center in the vertical direction of the second side wall 22C (in the embodiment, toward the upper wall 22D side of the second side wall 22C) such that it corresponds to the communication groove 11A. Both ends of the slit 28 in the insertion direction ID are formed to become wider gradually toward the outward direction (toward the front wall 22E or the rear wall 22F).

The upper wall 22D is formed by being folded from the first side wall 22B. At the upper wall 22D, a first contact part 29 and a second contact part 30 which protrude inward of the terminal body section 22 are provided. Similarly to the elastic part 24, the first contact part 29 and the second contact part 30 are disposed inside the terminal body section 22 and constitute female contact parts that contact the male connection part 27.

That is, when the connection terminal 20 is mounted in the housing 10, the male connection part 27 is inserted in the slit 28 of the adjacent connection terminal 20 via the communication groove 11A and is put between the elastic part 24, the first contact part 29, and the second contact part 30 as the female contact parts. From this, the connection terminals 20 that are adjacent with each other become electrically connected.

The front wall 22E is provided at the front end of the insertion direction ID and is formed by being folded from the upper wall 22D. The rear wall 22F is provided at a more rear side than the front wall 22E of the insertion direction ID and is formed by being folded from the upper wall 22D.

At the front wall 22E and the rear wall 22F, cutouts 31, 32 through which the male connection part 27 can pass are formed respectively at a position that aligns with the slit 28. The cutouts 31, 32 are formed so as to correspond to the positions of the male connection part 27 and the slit 28 respectively. The cutouts 31, 32 are formed such that they open to the slit 28 and become gradually narrower in a direction from the second side wall 22C to the first side wall 22B.

Regarding an assembly method of the connector 1 according to the embodiment, explanations will be given briefly by referring to FIGS. 7A, 7B, 8A, and 8B. Further, in FIGS. 7A and 7B, description of the housing 10 is omitted.

First, the connection terminal 20 is gradually inserted in each terminal accommodating chamber 12 of the housing 10. Then, the male connection part 27 is gradually inserted in the slit 28 of the adjacent connection terminal 20 by passing through the communication groove 11A of the housing 10 and through the cutout 31 or the cutout 32 of the adjacent connection terminal 20.

And when the connection terminal 20 is completely fitted inside the housing 10 (see FIGS. 2 and 3), the male connection part 27 is put between the elastic part 24, the first contact part 29, and the second contact part 30. From this, the adjacent connection terminals 20 become electrically connected with each other.

Figure 7A:
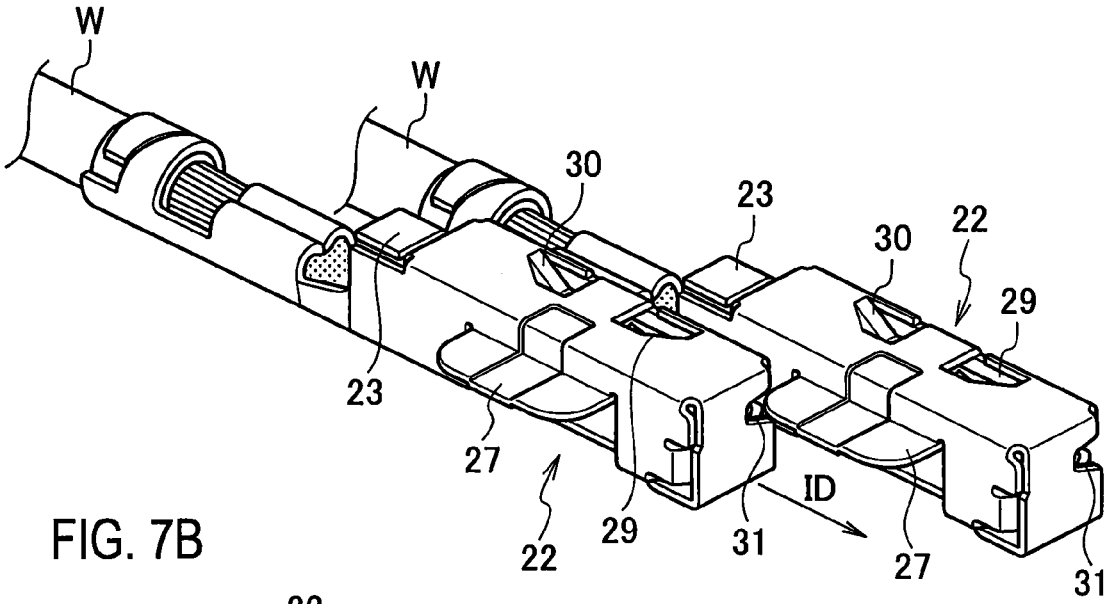
FIGS. 7A and 7B are perspective views each illustrating an assembly process of the connector according to the embodiment.
Figure 7B:
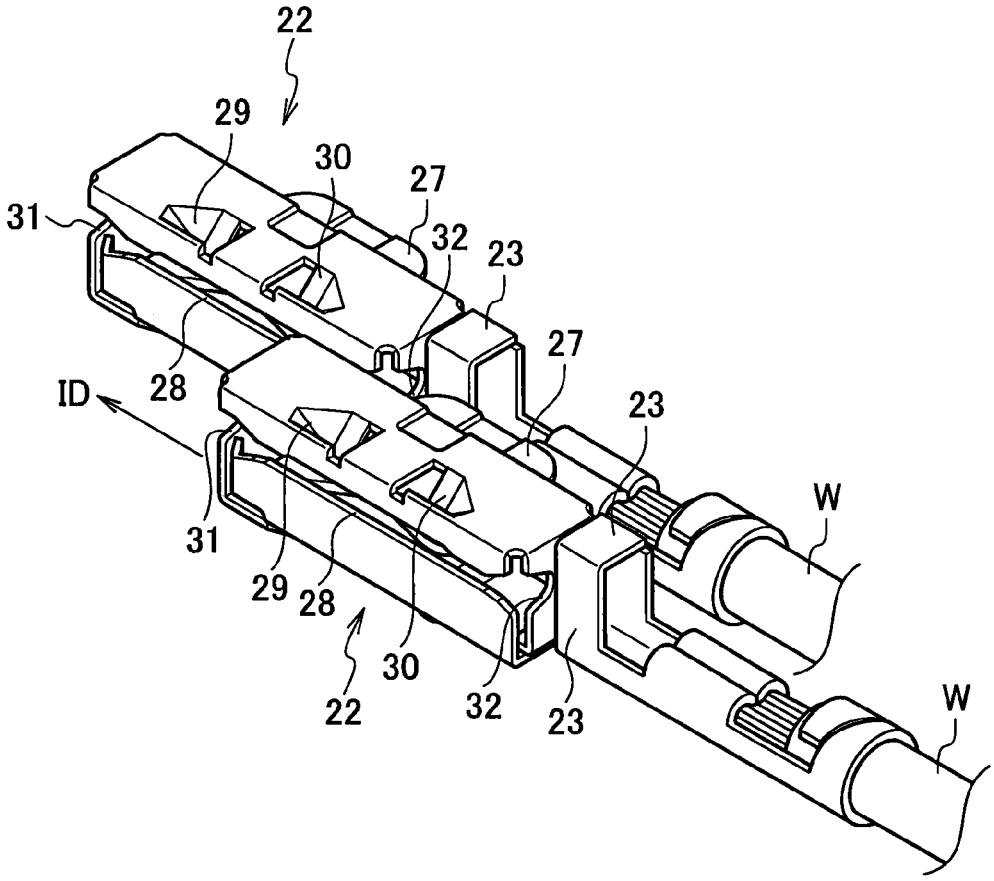

On this occasion, the slit 28 is formed so as to pass through the terminal body section 22 along the insertion direction ID. Thus, the male connection part 27 can be inserted both from the front wall 22E side as illustrated in FIG. 7A or from the rear wall 22F side as illustrated in FIG. 7B.

Figure 8A:
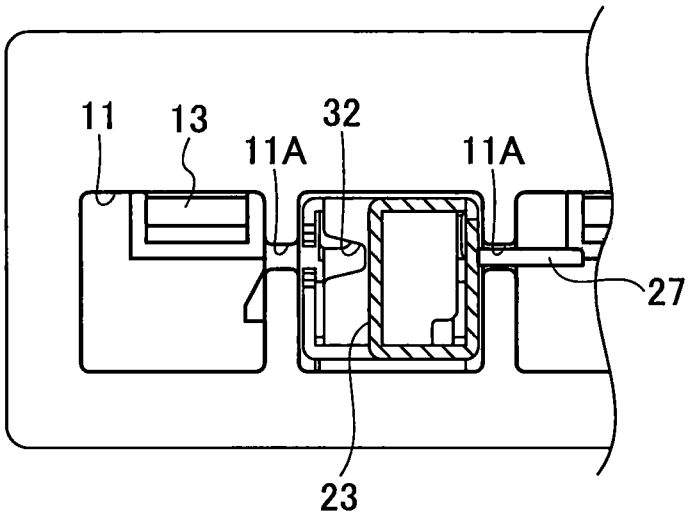
FIGS. 8A and 8B are back views each illustrating the connector according to the embodiment.
Figure 8B:
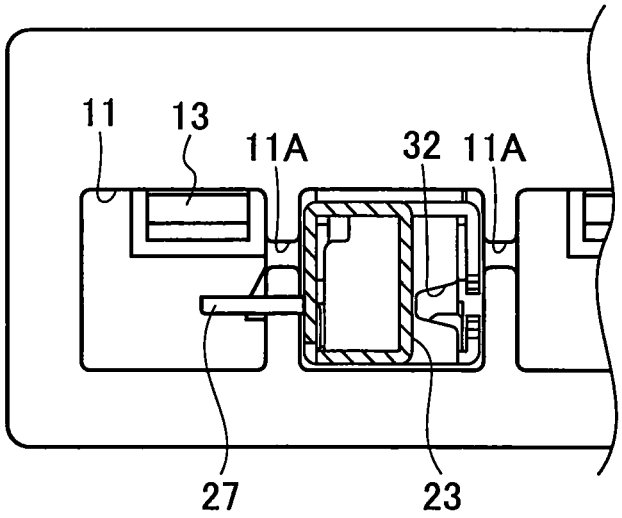

Here, as illustrated in FIG. 8B, if the connection terminal 20 is inserted into the housing 10 in a wrong orientation (for example. an orientation of up and down), the male connection part 27 abuts the partition wall 11 and it can be prevented from being inserted in the communication groove 11A in the opposite side from usual.

Figure 9A:
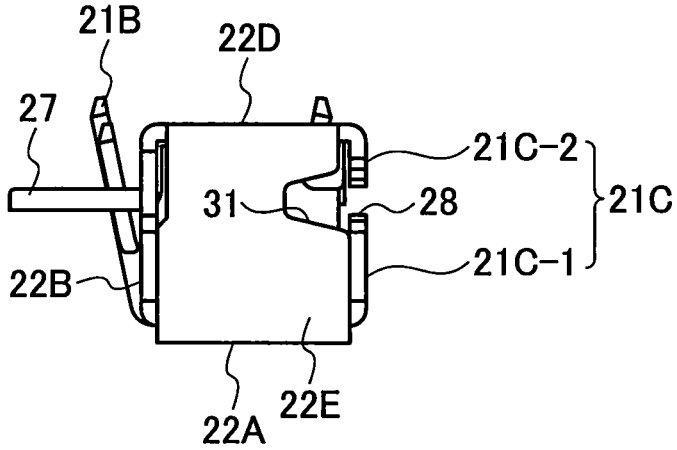
FIGS. 9A and 9B are front views illustrating the connection terminal according to the embodiment.

Also, as another state, first as illustrated in FIG. 9A, when the male connection part 27 is not deformed, the connection terminal 20 is gradually inserted in each terminal accommodating chamber 12 of the housing 10. Then, the male connection part 27 is gradually inserted in the slit 28 of the adjacent connection terminal 20 by passing through the communication groove 11A and the cutout 31 or the cutout 32.

Then, when the connection terminal 20 is completely fitted inside the housing 10 (see FIGS. 2 and 3), the male connection part 27 is put between the elastic part 24, the first contact part 29, and the second contact part 30. Thus, the adjacent connection terminals 20 are electrically connected with each other.

In this occasion, the slit 28 is formed so as to pass through the terminal body section 22 along the insertion direction ID. Therefore, the male connection part 27 can be inserted from the front wall 22E side as illustrated in FIG. 7A or from the rear wall 22F side as illustrated in FIG. 7B.

Figure 9B:
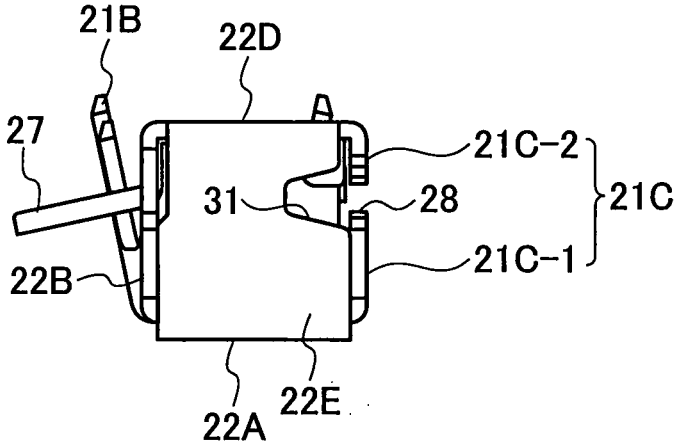
Figure 9C:
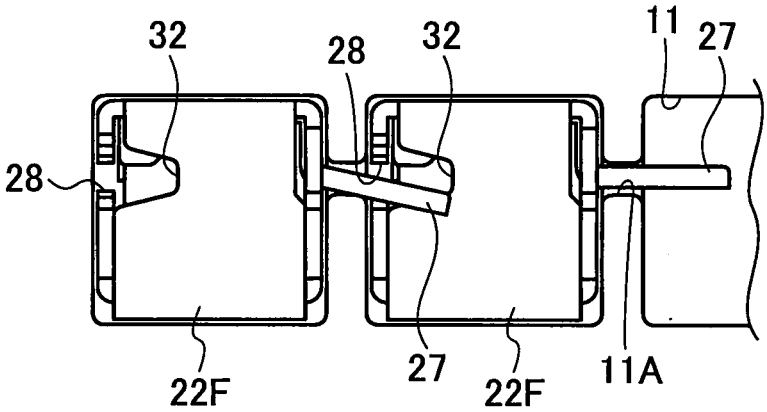
FIG. 9C is a back view illustrating the connector according to the embodiment.

Here, as illustrated in FIGS. 9B and 9C, when the male connection part is deformed (when it is tilted relative to the horizontal direction), at the time of insertion of the male connection part 27 in the slit 28, the male connection part 27 abuts the front wall 22E or the rear wall 22F without being inserted in the cutout 31 or the cutout 32. From this, it is possible to detect that the male connection part 27 is deformed, and it is possible to prevent the deformed male connection part 27 from being inserted in the slit 28.

The communication groove 11A is provided at a position offset from the center in the vertical direction of the terminal accommodating chamber 12. Also, the male connection part 27 and the slit 28 are provided at a position offset from the center in the vertical direction of the terminal body section so as to correspond to the communication groove 11A. From this, even if an insertion orientation of the connection terminal 20 into the housing 10 is wrong, the male connection part 27 abuts the partition wall 11 and it is possible to prevent (detect) the insertion in the communication groove 11A in the opposite side from usual. Accordingly, the adjacent connection terminals 20 can be connected securely with each other without causing an error in the insertion orientation of the plurality of connection terminals 20.

Moreover, since an error in the insertion orientation of the male connection part 27 can be detected, it is not necessary to separately provide a detection mechanism in the connector 1, making it possible to keep the connector from becoming complex and large-sized.

The slit 28 is formed so as to pass through the terminal body section 22. From this, when the male connection part 27 of one connection terminal 20 is inserted in the slit of the adjacent other connection terminal 20, it is possible to insert and attach both from the front end and the rear end of the terminal body section 22. Therefore, it is possible to connect the adjacent connection terminals 20 with each other reliably without causing constraints in an installment order of the adjacent connection terminals 20.

The terminal body section 22 includes the front wall 22E and the rear wall 22F. From this, opening at the front end and the rear end of the terminal body section 22 is blocked and strength of the terminal body section 22 is increased. This makes it harder for the terminal body section 22 to become deformed even if an external force is applied to the terminal body section 22.

At the front wall 22E and the rear wall 22F, the cutouts 31, 32 through which the male connection part 27 can pass are formed. From this, when the male connection part 27 of one connection terminal 20 is inserted in the slit 28 of the adjacent other connection terminal 20, it is possible to prevent the male connection part 27 from abutting the front wall 22E or the rear wall 22F, making connecting operation of the connection terminals 20 with each other easy. Moreover, at the time of insertion of the male connection part 27 into the slit 28, when the male connection part 28 is deformed (when it is tilted from the horizontal direction), the male connection part 27 abuts the front wall 22E or the rear wall 22F without being inserted in the cutouts 31 or 32. From this, it is possible to detect that the male connection part 27 is deformed, and it is possible to prevent the deformed male connection part 27 from being inserted in the slit 28. Therefore, only the normal male connection part 27 that is not deformed is reliably inserted in the slit 28 and the male connection part 27 reliably contacts the elastic part 24, the first contact part 29, and the second contact part 30 as the female contact parts.

In the embodiment, the cutouts 31, 32 are formed so as to become gradually narrower in a direction from the side wall 22C to the side wall 22B. From this, even when deformation of the male connection part 27 (tilt from the horizontal direction) is small, it becomes easier for the male connection part 27 to abut the front wall 22E or the rear wall 22F (periphery of the cutouts 31, 32) and it becomes easier to detect deformation of the male connection part 27. Therefore, it is possible to prevent the deformed male connection part 27 from being inserted in the slit 28 more reliably.

(Other Embodiments)

As described above, contents of the present invention have been disclosed through the embodiment, but the discussions and the drawings that constitute a part of this disclosure should not be understood as something that limits the present invention. Various alternative embodiments, working examples, and operation techniques are apparent from this disclosure.

For example, the embodiment of the present invention can be altered as follows. In particular, regarding the shape and the like of the connector 1, it is not limited to the one explained in the embodiment, but it can be set appropriately. In fact, naturally, shapes and the like of the housing 10 and the connection terminal 20 can also be set appropriately.

Further, it is not necessary for the communication groove 11A to be provided at a position offset from the center toward the upper face side of the terminal accommodating chamber 12, but it can be formed at a position offset from the center toward the lower face side of the terminal accommodating chamber 12. In this case, it is sufficient as long as the male connection terminal 27, the slit 28, and the cutouts 31, 32 are formed so as to correspond to the communication groove 11A.

Also, the wire connection part 21 does not necessarily have to be provided at a position that is out of alignment with the terminal body section 22 (toward the side wall 22B), but it can be in alignment with the terminal body section 22.

As such, the present invention naturally includes various embodiments that are not described here. Therefore, the technical scope of the present invention should be defined by only the matters specifying the invention pertaining to the claims which are appropriate from the above explanations.

What is claimed is:

1. A connector, comprising:

a housing provided with a plurality of terminal accommodating chambers respectively separated by a partition wall, the partition wall having a communication groove formed to communicate the terminal accommodating chambers that are adjacent with each other; and a connection terminal having a wire connection part to which wire is connected and a terminal body section connected to the wire connection part, wherein with mounting of the connection terminal in the housing, the adjacent terminal body sections contact with each other and the adjacent connection terminals are electrically connected, wherein the terminal body section comprises:

a first side wall on which a male connection part is formed, the male connection part being disposed along an extended direction from a front end to a rear end of the terminal body section and being protruded outward;

a second side wall opposite to the first side wall, the second side wall being provided with a slit in which the male connection part can be inserted;

a female contact part provided inside the terminal body section, the female contact part to be contact to the male connection part inserted in the slit;

a front wall disposed in a direction that intersects with the extended direction of the terminal body section, the front wall being located at a front end of the terminal body section; and a rear wall opposite to the front wall, the rear wall being disposed at a rear end of the terminal body section, wherein the slit is formed so as to pass through the terminal body section along the extended direction of the terminal body section, wherein a cutout through which the male connection part can pass is formed in the front wall and the rear wall respectively at a position that aligns with the slit, wherein the communication groove is provided at a position offset from the center in the vertical direction of the terminal accommodating chamber, and wherein the male connection part and the slit are provided at a position offset from the center in the vertical direction of the terminal body section so as to correspond to the communication groove.

2. A connection terminal, comprising:

a box-shaped terminal body section formed by bending a conductive plate having a predetermined shape, wherein the terminal body sections that are adjacent with each other contact to be electrically connected, wherein the terminal body section comprises:

a first side wall on which a male connection part is formed, the male connection part being disposed along an extended direction from a front end to a rear end of the terminal body section and being protruded outward;

a second side wall opposite to the first side wall, the second side wall being provided with a slit in which the male connection part can be inserted;

a female contact part provided inside the terminal body section, the female contact part to be contact to the male connection part inserted in the slit;

a front wall disposed in a direction that intersects with the extended direction of the terminal body section, the front wall being located at a front end of the terminal body section; and a rear wall opposite to the front wall, the rear wall being disposed at a rear end of the terminal body section, wherein the slit is formed so as to pass through the terminal body section along the extended direction of the terminal body section, and wherein a cutout through which the male connection part can pass is formed in the front wall and the rear wall respectively at a position that aligns with the slit.

3. The connection terminal according to claim 2, wherein the cutout is formed so as to become narrower gradually in a direction from the second side wall to the first side wall.

* * * * *